US007128367B2

(12) United States Patent
You et al.

(10) Patent No.: US 7,128,367 B2
(45) Date of Patent: Oct. 31, 2006

(54) FOLDABLE HIGHCHAIR FRAMEWORK

(75) Inventors: Youn-Fu You, Chia Tai Industrial Tai Pao (TW); Wei-Yeh Li, Chia Tai Industrial Tai Pao (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 10/951,096

(22) Filed: Sep. 27, 2004

(65) Prior Publication Data

US 2005/0242646 A1 Nov. 3, 2005

(30) Foreign Application Priority Data

Apr. 16, 2004 (CN) ..... 2004 2 0044787

(51) Int. Cl.
*A47D 1/02* (2006.01)
*A47C 4/00* (2006.01)

(52) U.S. Cl. ..... 297/48; 297/47; 297/344.1

(58) Field of Classification Search ..... 297/16.1, 297/16.2, 24, 25, 46, 47, 55, 56, 118, 130, 297/344.1, 148–150, 151–153, 48
See application file for complete search history.

(56) References Cited

U.S. PATENT DOCUMENTS 1,609,689 A * 12/1926 Bugenhagen ..... 297/48
2,851,086 A * 9/1958 Weiner ..... 297/39
3,425,743 A * 2/1969 Peterson ..... 297/19
4,580,833 A * 4/1986 Waples ..... 297/39
4,603,902 A * 8/1986 Maloney ..... 297/35
4,741,551 A * 5/1988 Perego ..... 280/642
4,768,825 A * 9/1988 Quinlan, Jr. ..... 297/39
4,938,603 A * 7/1990 Turner et al. ..... 297/16.1
4,958,885 A 9/1990 Kassai ..... 297/55
5,104,180 A * 4/1992 Takahashi et al. ..... 297/16.1
5,165,755 A * 11/1992 Rho ..... 297/344.18
5,238,292 A * 8/1993 Golenz et al. ..... 297/153
5,348,374 A 9/1994 Kuo ..... 297/344.18
5,435,620 A 7/1995 Cheng ..... 297/51
5,507,550 A 4/1996 Maloney ..... 297/153
5,509,719 A 4/1996 Cone, II ..... 297/344.14
5,806,922 A 9/1998 Mendelovich ..... 297/130
5,829,826 A 11/1998 Ziccardi ..... 297/118
5,927,805 A 7/1999 Hilger et al. ..... 297/239
5,951,102 A 9/1999 Poulson et al. ..... 297/130
6,010,184 A 1/2000 Lee et al. ..... 297/130
6,126,236 A * 10/2000 Wu ..... 297/325
6,347,830 B1 * 2/2002 Chen ..... 297/16.1

FOREIGN PATENT DOCUMENTS

GB 2386832 A * 10/2003

* cited by examiner

*Primary Examiner*—Peter M. Cuomo
*Assistant Examiner*—Joseph Edell
(74) *Attorney, Agent, or Firm*—Alan D. Kamrath; Nikolai & Mersereau, P.A.

(57) ABSTRACT

A foldable highchair framework includes a folded support stand, a chair, a link assembly and a positioning mechanism. The folded support stand includes a front stand and a rear stand capable of being drawn close. The chair includes a seat and a backrest pivoted to each other. The link assembly is pivoted between the folded support stand and the chair. When the positioning mechanism of this invention releases the chair, the rear stand is able to draw close to the front stand. The linking operation with the link assembly allows folding of the chair and the backrest at the same time, to form a foldable highchair framework with a compact size.

9 Claims, 6 Drawing Sheets

FOLDABLE HIGHCHAIR FRAMEWORK

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of the Invention

This invention relates to a foldable highchair framework that is able to fold a chair through a link assembly at the time of releasing a positioning device.

2. Background

Highchairs are usually used as a toddler-dining apparatus. The structures of the conventional highchairs may be referred to U.S. Pat. Nos. 5,435,620; 4,958,885; 5,509,719; 5,348,374; 5,507,550; 5,806,922; 5,829,826; 5,927,805; 5,951,102 and 6,010,184. The highchair structure generally consists of a chair portion and a leg portion that erects the highchair above the ground. The highchair is usually equipped with a toddler-dinner tray.

The common forms for the legs of the highchairs are generally categorized in a stationary form, such as those disclosed in U.S. Pat. Nos. 5,806,922 and 5,927,805, an expandable form, such as those disclosed in U.S. Pat. Nos. 5,507,550 and 5,951,102, in which two of the legs are connected to the same location and the bottoms of the legs may be expanded at an angle for supporting the highchair above the ground, or an inclined form, such as those disclosed in U.S. Pat. Nos. 5,509,719; 5,435,620 and 4,958,885, in which the legs include a first leg horizontally lying over the ground and a second leg having a first end connected to the first leg and assuming an inclined angle with respect to the first leg. The leg that is horizontally laid over the ground may also be categorized into a stationary form (such as U.S. Pat. No. 5,509,719), an assembled form (such as U.S. Pat. No. 5,435,620) and a foldable form (such as U.S. Pat. No. 4,958,885). The, fixed form is unfoldable such that it will occupy a relatively large area in storage. The assembled form allows disassembly of the highchair in storage but is inconvenient as it requires repeated assembly and disassembly. The foldable form allows easy folding operations upon drawing the first leg close to the second leg. However, the folding mechanism disclosed in U.S. Pat. No. 4,958,885 is relatively complicated.

SUMMARY OF THE INVENTION

In view of the above, the primary object of this invention is to provide a foldable highchair framework.

According to this invention, the foldable highchair framework includes: a foldable support stand, a chair, a link assembly and a positioning mechanism. The folded support stand includes a front stand, a rear stand and a pivoting base connected to each other. The pivoting base is connected to the upper ends of the front stand and rear stand, such that upon folding the folded support stand, the front stand and rear stand would pivot to be drawn close. The chair includes a seat and a backrest pivoted to each other. The chair is connected to the foldable support stand through the link assembly. Upon manipulating the positioning device provided between the folded support stand and the chair, the chair would be folded at the same time to form a foldable framework of a compact size.

BRIEF DESCRIPTION OF THE DRAWINGS

These and other modifications and advantages will become even more apparent from the following detailed description of a preferred embodiment of the invention and from the drawings in which.

DETAILED DESCRIPTION OF THE INVENTION (PREFERRED EMBODIMENTS)

Figure 1:
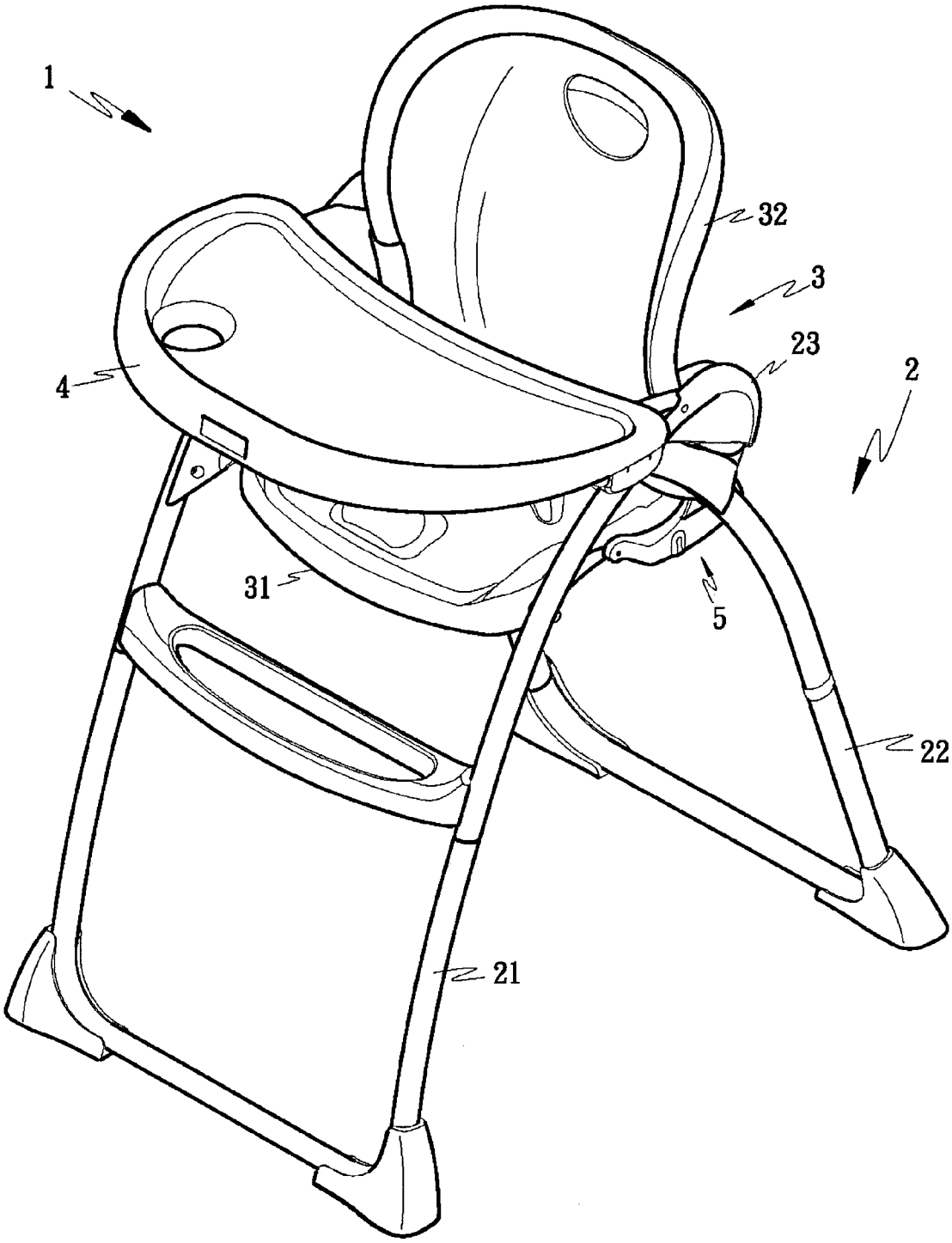
FIG. 1 is a perspective view illustrating the framework of this invention under the expanded state.

With reference to FIG. 1, this invention provides a foldable highchair framework 1 that may be folded to a compact size to allow easy storage. The framework 1 includes a folded support stand 2, a chair 3, a link assembly 5 and a positioning mechanism 6.

Figure 3:
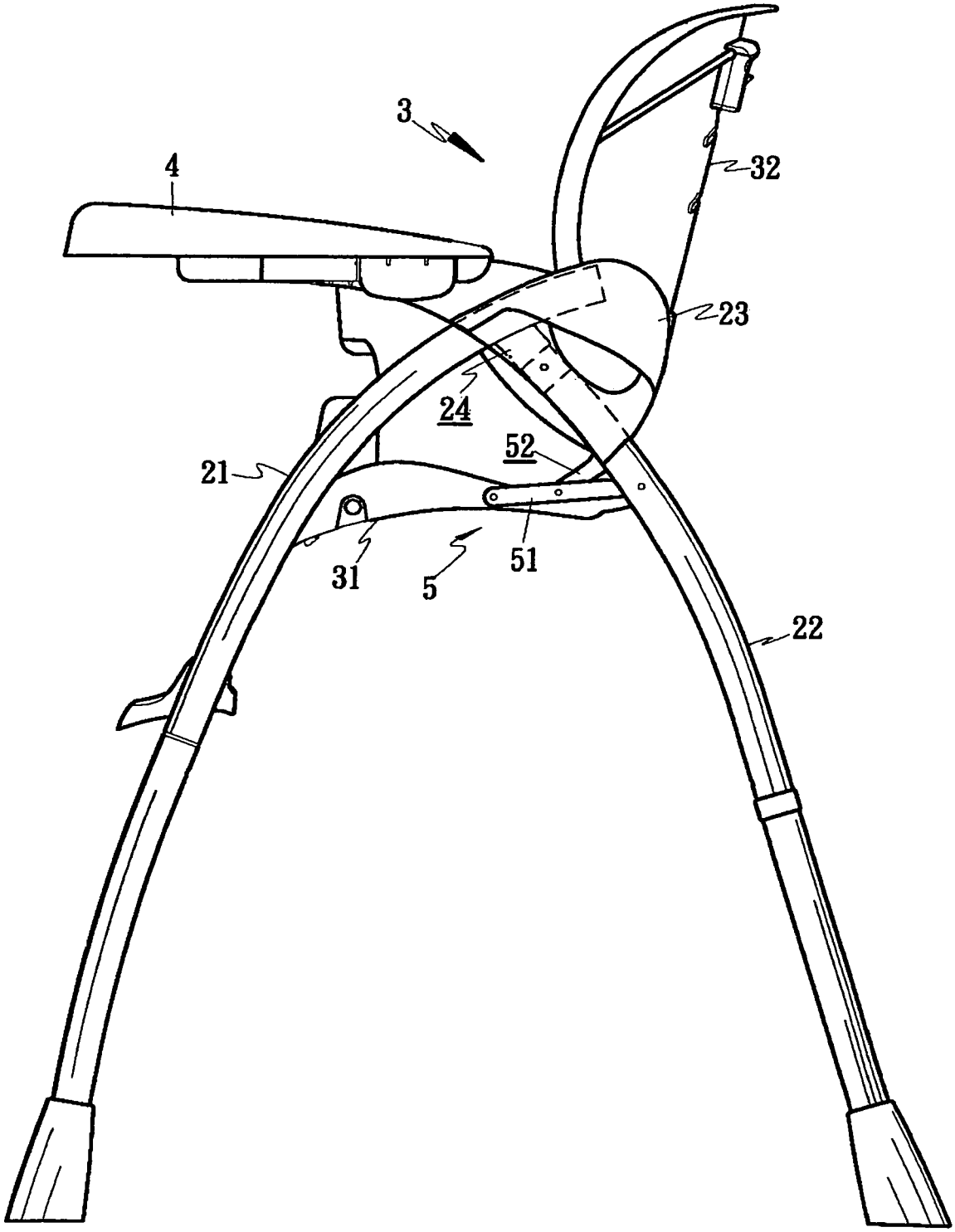
FIG. 3 is a side elevational view illustrating the framework of this invention under the expanded state.

The folded support stand 2 includes a front stand 21, a rear stand 22 and a pivoting base 23. The front stand 21 and the rear stand 22 are each configured as an inverse-U-like shape. In this embodiment, the pivoting base 23 is connected to the upper ends of the front and rear stand 21, 22. The upper end of the front stand 21 is connected to a connection tab 24 (as shown in FIG. 3). The connection tab 24 is pivoted to the upper end of the rear stand 22 (or alternatively subjecting the upper end of the rear stand 22 to pivot the pivoting base 23 directly). Upon expanding this invention, the front and rear stands 21, 22 would rotate about the pivoting base 23 to form the support stand 2 for suspending the chair 3. In folding, the front stand 21 and the rear stand 22 also pivot about the pivoting base 23 so as to be drawn close. The pivoting base 23 may be provided at a front end thereof with a dinner tray 4 that may be adjusted back and forth.

Figure 2:
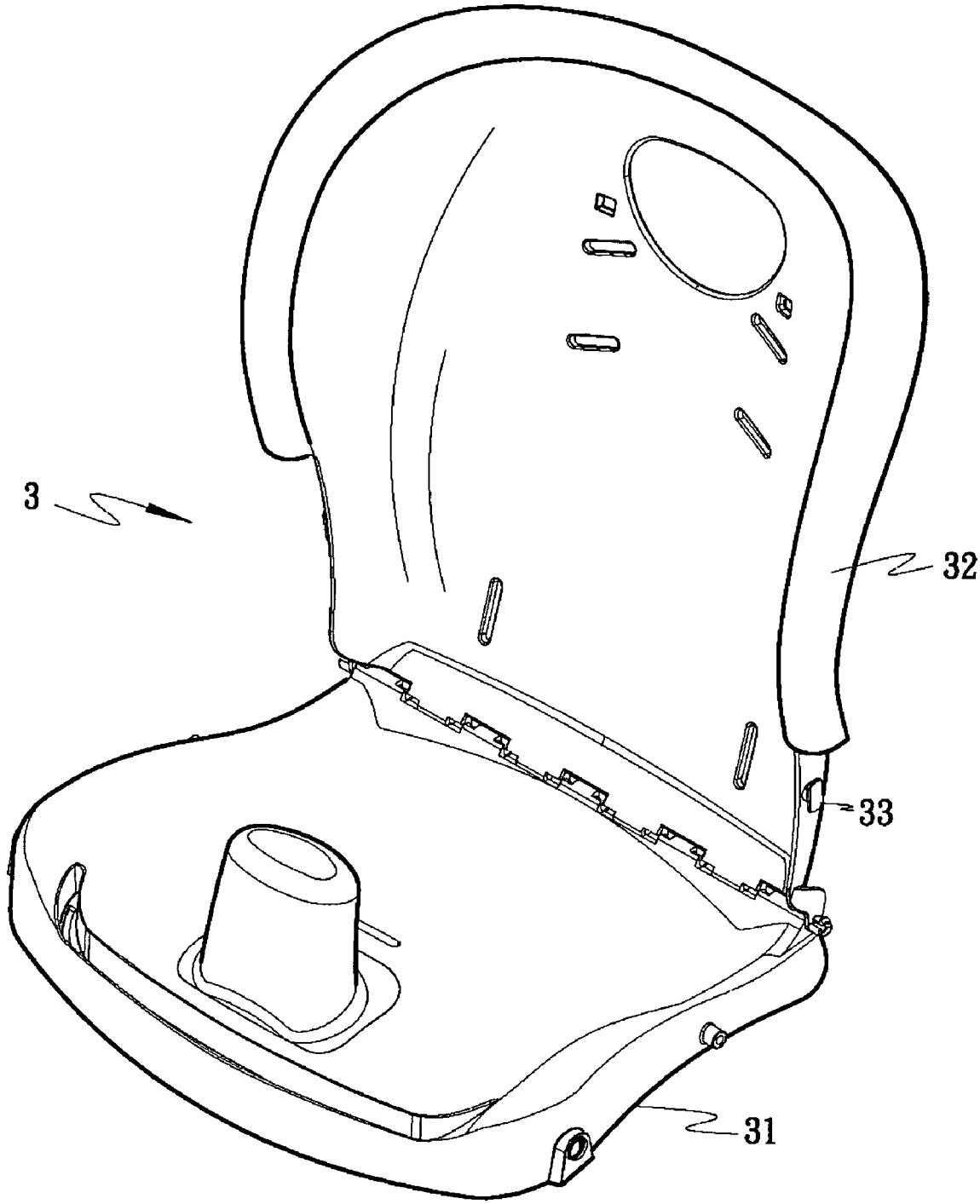
FIG. 2 is a perspective view of the chair according to this invention.

The chair 3 includes a seat 31 and a backrest 32 (see FIG. 2). The seat 31 and the backrest 32 are pivoted to each other. The seat 31 of the chair is pivoted to the front stand 21, subjecting the seat 31 and the backrest 32 of the chair 3 to be apart by approximately 90 degrees or greater than 90 degrees after expanding the framework, for seating a toddler, and subjecting the seat 31 and the backrest 32 to be apart by less than 90 degrees after folding the framework 1. The backrest 32 is provided with a wedge portion 33.

The link assembly 5 is pivoted between the chair 3 and the folded support stand 2, and includes a first link 51 and a second link 52. The first link 51 is pivoted between the seat 31 of the chair 3 and the rear stand 22. The second link 52 is pivoted between the backrest 32 and the first link 51. In folding, the rear stand 22 would move towards the front stand 21 and the first and second links 51, 52 to link the seat 31 and the backrest 32 of the chair 3 for folding the seat 31 and the backrest 32 apart by an included angle less than 90 degrees.

Figure 4:
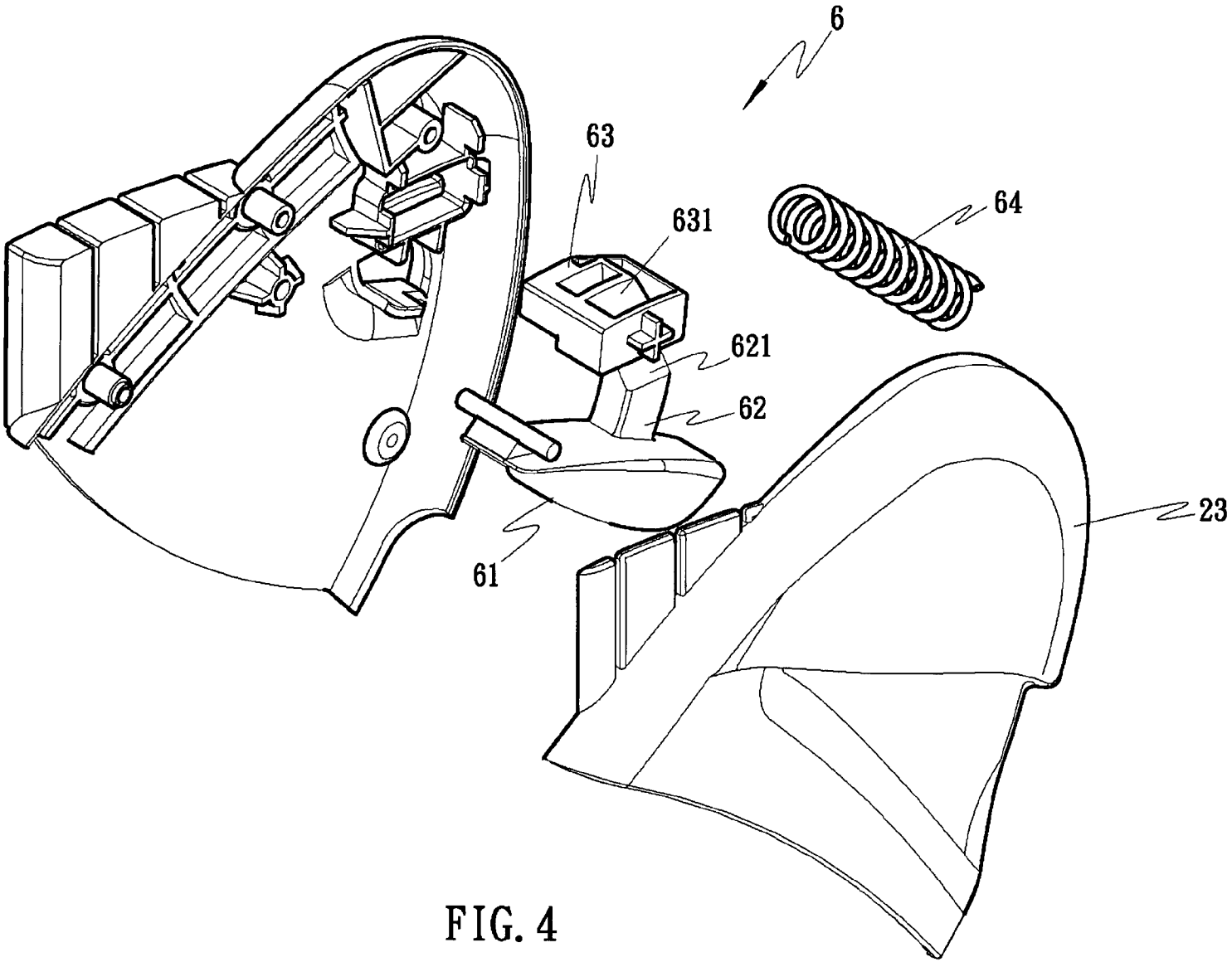
FIG. 4 is an exploded, perspective view showing the components included in the positioning mechanism of this invention.
Figure 5:
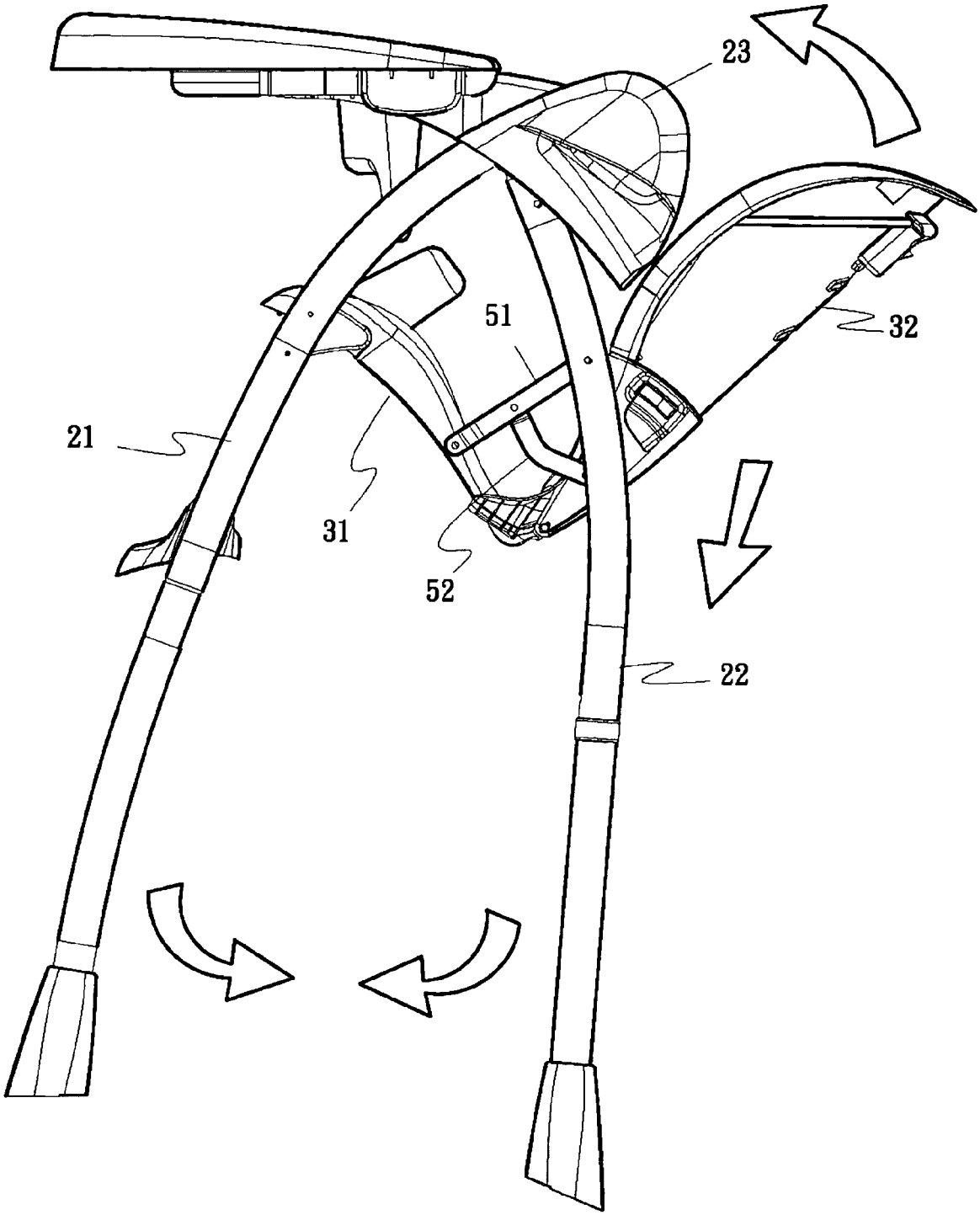
FIG. 5 is a schematic view illustrating the framework of this invention under the state of being folded.
Figure 6:
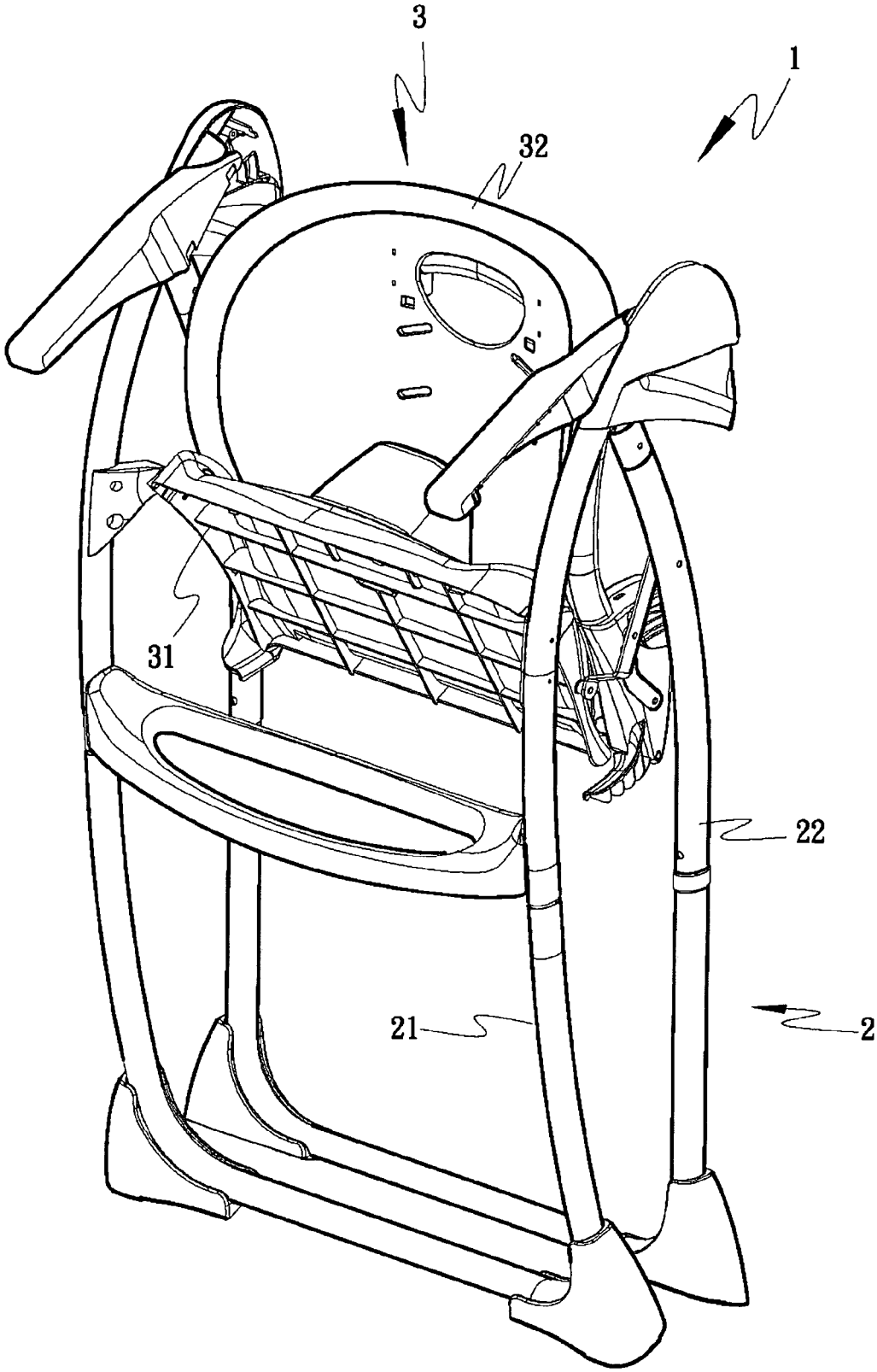
FIG. 6 is a schematic view illustrating the framework of this invention after being folded.

The positioning mechanism 6 (see FIG. 4) is provided to the pivoting base 23 and engaged to the chair 3, and includes a pushbutton 61, a driving piece 62, a wedge piece 63 and a resilient member 64. After expanding the highchair framework 1, the wedge piece 63 is projected out of the pivoting base 23 under the resilience of the resilient member 64, and engaged, fixed to the wedge portion 33 provided to the backrest 32 of the chair 3, thereby preventing the overall highchair framework 1 from rotation to assume a fixed state. In folding the framework 1, the pushbutton 61 may be pushed such that opposing oblique faces 621, 631 are provided, respectively, to the driving piece 62 and the wedge piece 63. The wedge piece 63 is caused to move towards the pivoting base 23, thereby disengaging from the wedge portion 33, so as to turn the highchair framework 1 into a folded state (as shown in FIG. 5). At the same time that the rear stand 22 is drawn close to the front stand 21, the backrest 32 and seat 31 of the chair 3 would be folded through the link assembly 5, thereby turning the highchair into a compact size allowing easy storage and transportation (as shown in FIG. 6).

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

What is claimed is:

1. A foldable highchair framework comprising:

a folded support stand including a front stand, a rear stand and a pivoting base connected to each other, wherein the pivoting base is connected to the upper ends of the front stand and rear stand, and the front stand and the rear stand are drawn close in folding the folded support stand;

a chair for seating a toddler, with the chair pivotally mounted to the folded support stand, with the chair including a seat and a backrest pivoted to each other;

a link assembly pivotally engaging the folded support stand and the chair, with the linking assembly linking the folded support stand with the seat and the backrest of the chair to be drawn close as the front and rear stands are drawn close; and a positioning mechanism provided between the folded support stand and the chair for manipulating the highchair framework to expand the highchair into a fixed state or releasing the highchair into a folded state, wherein the chair further includes a wedge portion engageable with the positioning mechanism to take on the fixed state, wherein the positioning mechanism further includes a pushbutton, a driving piece, a wedge piece and a resilient member, with the pushbutton pivotally mounted to the pivoting base of the folded support stand, with the wedge piece mounted to the pushbutton by the driving piece, wherein the wedge piece is engaged to the wedge portion of the chair by the resilient member.

2. The foldable highchair framework of claim 1 wherein the front stand and the rear stand are each configured as an inverse-U shape.

3. The foldable highchair framework of claim 1 wherein the front stand includes a top end connected to a connection tab that is pivoted to a top end of the rear stand.

4. The foldable highchair framework of claim 1 wherein the wedge portion is provided to the backrest.

5. The foldable highchair framework of claim 1 wherein the link assembly includes a first link and a second link, the first link being pivoted between the seat and the rear stand, the second link being pivoted between the backrest and the first link.

6. The foldable highchair framework of claim 1 wherein the driving piece and wedge piece each include an oblique face opposing each other, such that the wedge piece is disengaged from the wedge portion of the chair upon pushing the oblique faces upon driving the driving piece through the pushbutton.

7. A foldable highchair framework comprising:

a folded support stand having a front stand, a rear stand, and a pivoting device having a pivoting point for pivoting the front stand and the rear stand, and allowing the front stand and the rear stand to expand and be in a fixed state at a certain angle or to be drawn close upon releasing the fixed state, wherein the pivoting device includes a link assembly and a positioning mechanism, the link assembly being provided between the rear stand and the backrest for linking the backrest to fold;

a seat for seating a toddler; and a backrest pivoted to the seat and serving as a backrest while seating the toddler, wherein the seat and the backrest are each pivoted to the folded support stand, and expanded upon expanding the front stand and the rear stand and drawn close upon drawing close the front stand and the rear stand, wherein the backrest includes a wedge portion, the wedge portion being engageable with the positioning mechanism to take on the fixed state wherein the positioning mechanism further includes a pushbutton, a driving piece, a wedge piece and a resilient member, with the pushbutton pivotally mounted to the pivoting base of the folded support stand, with the wedge piece mounted to the pushbutton by the driving piece, wherein the wedge piece is engaged to the wedge portion of the chair by the resilient member.

8. The foldable highchair framework of claim 7, wherein the link assembly includes a first link and a second link, the first link being pivoted between the seat and the rear stand, the second link being pivoted between the backrest and the first link, such that the first link and the second link causes folding of the backrest upon rotating the rear stand.

9. The foldable highchair framework of claim 7, wherein the driving piece and wedge piece each include an oblique face opposing each other, such that the wedge piece is disengaged from the wedge portion of the chair upon pushing the oblique faces upon driving the driving piece through the pushbutton.

* * * * *